United States Patent [19]

Bullock

[11] Patent Number: 4,696,138

[45] Date of Patent: Sep. 29, 1987

[54] INSULATION CONFIGURATIONS AND METHOD OF INCREASING INSULATION EFFICIENCY

[76] Inventor: Christopher A. Bullock, 3321 Pines Rd., Shreveport, La. 71119

[21] Appl. No.: 688,876

[22] Filed: Jan. 4, 1985

Related U.S. Application Data

[63] Continuation-in-part of Ser. No. 577,525, Feb. 6, 1984.

[51] Int. Cl.[4] ..... E04B 2/00

[52] U.S. Cl. ..... 52/407; 52/408; 52/268

[58] Field of Search ..... 52/404–407, 52/483, 393, 743, 746, 309.8, 408, 410, 426, 262, 265, 268, 269; 156/71; 428/68, 69, 71, 74, 76, 316.6

[56] References Cited

U.S. PATENT DOCUMENTS

| | | | |
|---|---|---|---|
| 1,637,497 | 8/1927 | O'Dowd | 428/76 X |
| 1,859,996 | 5/1932 | Simpson | 52/406 |
| 2,330,941 | 10/1943 | Acuff, Jr. | 52/406 X |
| 2,495,636 | 1/1950 | Hoeltzel et al. | 52/406 X |
| 2,579,036 | 12/1951 | Edelman | 52/406 X |

FOREIGN PATENT DOCUMENTS

| | | | |
|---|---|---|---|
| 2700468 | 6/1978 | Fed. Rep. of Germany | 52/406 |

OTHER PUBLICATIONS

"Insulation, Building, Mineral Wool; Batts, Loose-Fill, and Granular Fill", Federal Standard Stock Catalog, Section IV, Part 5, No. HH-I-521c, 1937.

*Primary Examiner*—Carl D. Friedman
*Assistant Examiner*—Naoko N. Slack
*Attorney, Agent, or Firm*—John M. Harrison

[57] ABSTRACT

Insulation configurations for the ceiling, floor and walls of structures, which include in a first embodiment, at least one layer of particulate or "blown" insulation with a water vapor-permeable film or films isolating the layer or layers to limit air circulation and infiltration through the layers. In another embodiment, sheets of a moisture vapor-permeable film membrane are provided in association with insulating "batts" or rolled sheet, fibrous, non-solid insulation to divide the insulation into discrete layers and limit air infiltration through the layers. A method for increasing the efficiency of insulating material in structures, which includes providing one or more moisture or water vapor-permeable membrane films or membranes in association with the insulating material to isolate the insulation in discrete layers and limit air infiltration and circulation through the layers.

15 Claims, 11 Drawing Figures

INSULATION CONFIGURATIONS AND METHOD OF INCREASING INSULATION EFFICIENCY

CROSS-REFERENCE TO RELATED APPLICATION

This application is a continuation-in-part of my copending patent application Ser. No. 06/577,525, filed Feb. 6, 1984, and entitled "Ceiling Insulation Structure and Method of Installation"

BACKGROUND OF THE INVENTION

Field of the Invention

This invention relates to the insulation of structures and more particularly, to ceiling, floor and wall insulation configurations which incorporate at least one water vapor-permeable film or membrane covering, and/or located between layers of stranded fibrous, non-solid insulation, such as fiberglass insulation, which film substantially prevents the circulation or infiltration of air through the isolated insulation layers. The invention further relates to a method for increasing the efficiency of insulation in selected insulation configurations by covering, and/or inserting one or more sheets of water vapor-permeable film in particulate, batt or rolled insulation, to define boundaries for discrete layers or cells of insulation. The insulation configuration improvement and method of improving efficiency of this invention is characterized in one embodiment by one or more relatively thin, moisture-permeable films or membranes, substantially encapsulating, and/or situated between adjacent layers of insulation, which insulation configuration is supported by the ceiling structure between the ceiling joints of an attic, in walls between studs, or between other supporting members in floors, where the structure is not constructed on a slab, in order to substantially prevent air from circulating through or infiltrating the insulation. Such insulation configurations are typically characterized by a quantity of particulate or "blown" insulation, batts of selected size and rolled sheets of insulation, each of which are provided with one or more sheets or coverings of a selected barrier material which is capable of preventing, or at least minimizing air infiltration or circulation, but will allow migration of water molecules through the insulation configuration. In a preferred embodiment of the invention sheets of 2 mil polyethylene plastic membrane or film are placed over and between layers or sheets of insulation material provided in the form of batts or particulate, blown insulation which is located on the ceiling sheet rock and between the ceiling joists of an attic, or between studs in a wall or between floor joists, in order to isolate the insulation from air which normally circulates through the attic and may infiltrate and circulate in the walls and beneath the floor. In a most preferred embodiment of the invention, the membranes cover and are positioned between successive layers of particulate insulation, either by alternately installing parallel sheets of membrane in the wall area, and then blowing the insulation into the resulting open cavities or blowing the insulation into the areas between ceiling or floor joists and stapling a sheet of film between the joists to isolate the insulation from air currents. In this manner, air which circulates through the attic, walls or beneath the floor is not permitted to easily infiltrate and circulate in all layers of the insulation to provide a conduit for heat movement from the attic of the structure to the interior thereof and from the interior into the attic, or through the walls or floor, as the case may be.

Conventional insulating techniques have taken the form of placing batts, rolled or blown, loose-fill insulation between the ceiling joists of an attic, the floor joists in a floor not constructed on a slab and in the walls of a structure, in order to provide a medium which contains air pockets designed to minimize the passage of heat from the attic into the interior of the structure and from the interior back into the attic, as well as through the walls and floors of the structure. The efficiency of such insulation is commonly measured in terms of an "R" factor, which depends upon the character and thickness of the insulation. Conventional attic insulation installation frequently includes the use of a "vapor barrier" sheeting positioned between the insulation and the drywall or sheetrock or alternative ceiling covering which separates the rooms of the structure from the attic itself and serves to retard the flow of water vapor and as a support for the insulation. The vapor barrier also serves as an insulating component. An insulation material such as fiberglass or other material capable of trapping air is placed on the sheetrock and between the ceiling joists in the form of batts, rolled strips or in particulate form, by way of blowing, and the structure is considered to be well insulated, depending upon the thickness and character of the insulation installed. An appropriate "R" value is assigned the insulation, based on tests conducted under controlled conditions in the laboratory. It has surprisingly been found that insulation installed in this manner has little effect upon the heat loss and gain of a structure, especially through the attic area under a variety of weather conditions and temperatures. Experiments have shown that use of a "vapor barrier" installed in the conventional manner described above does little to aid the insulation process, since air circulation in the attic also infiltrates and circulates through the insulation and destroys much of the efficiency of the insulation due to heat transfer by convection. In many cases, the sheetrock ceiling itself is the only effective insulating barrier between the interior of the structure and the attic.

It has also been determined that the use of one or more membranes or films of selected thickness and character installed at spaced intervals in and around the insulation does not, as widely believed, trap and retain excessive quantities of moisture between the membrane layers and the insulation to degrade the sheetrock or damage structural members. In contrast, it has been found that the moisture is able to readily move through the insulation and through the certain moisture-permeable films and membranes and escape into the attic itself, where the moisture is removed by ventilators, with no adverse effect on either the insulation or the underlying sheetrock or structural members. The addition of such moisture-permeable membrane or film layers to blown, rolled and batt insulation has been found to reduce heating and cooling costs by as much as 75% and represents a significant increase in the efficiency of the underlying insulation. Since it has been estimated, for example, that 80% to 90% of the heat gain or loss in a structure having an attic takes place through the attic, the insulation configuration and method of this invention as applied to the attic in the structure becomes extremely significant in energy conservation efforts. The key to such a dramatic improvement in insulation efficiency is the creation of discrete layers or pockets in the insulation material to limit air movement from one pocket to another and reduce the resulting heat transfer through the insulating layer by convection and conduction. These pockets, layers or cells are created by placing thin films of moisture vapor-permeable material such as plastic materials, including polyethylene film, (commonly sold under the "Visqueen" tradmark) and other materials which allow the migration of water vapor, such as butcher paper and like materials, around and/or in the insulation. Convection losses occur when the air infiltrates the insulation and conduction is effected through various structures, such as film, located in or around the insulation.

Data collected over the last six years using both experimental techniques on a pilot plant scale and in full size structures demonstrates that the application of one or more membranes of film layers over at least one side and extending through the insulation significantly improves the insulating properties of insulation. In an attempt to show that three inches of fiberglass insulation was equivalent to one inch of polyurethane, it was determined that the fiberglass insulation, as conventionally sold and used, has very little effect on air movement and convection heat loss in structures. It has also been determined through additional experiments that no loose-fill or fiber batt insulation will function efficiently without a membrane to stop, or at least reduce, air circulation and infiltration in the insulation. Further testing has shown that insulation applied in the attics of homes does not function as expected by home owners. All of the tests which have been conducted to data in this research project have confirmed that the heating and cooling costs in these homes could have been cut from between 50% to 75%, had a membrane such as polyethylene having a thickness of 2 mils, or 0.002 of an inch, been installed over the insulation. It has also been determined from extensive tests that moisture vapor readily passes through this polyethelene and moisture does not build up in the insulation because of this membrane.

Many efforts have been made in recent years to improve the insulating efficiency in structures, and typical of these efforts is the "Building Insulation and Method of Installation" disclosed in U.S. Pat. No. 4,155,208, to John A. Shanabarger. The insulation and method of this invention includes use of a sheet of heavy plastic and cooperating elongated plastic bags which fit between the studs of a wall structure and conform to the insulating spaces between the studs to insulate the walls. The bags are resilient, they can be expanded volumetrically to substantially fully occupy the spaces between the studs and the bags can be attached to the studs by stapling, or by other techniques. U.S. Pat. No. 3,298,150, to D.E. Ahlquist, discloses "Wall Insulation Structures and Method of Using Same", and describes insulation for walls and other surfaces which are characterized by multiple blocks of insulating material contained in an envelope having side panels which are disposed along the walls to insulate the walls. Another insulating wall structure is disclosed in U.S. Pat. No. 3,641,724, to James Palmer, which structure includes an integral box construction built directly into a selected wall section and further includes interior foam materials such as various urethanes, to provide the necessary insulation. An "Insulated Roof" is disclosed in U.S. Pat. No. 4,147,003, to Robert J. Alderman, which roof includes a reel of flexible sheet material mounted on a support frame and situated over a space between adjacent roof purlins. This framework is moved along the purlins and the sheet material is progressively unrolled, formed and guided by the framework down into the space between the purlins. Insulation material is placed in the trough on top of the sheet material in order to insulate the roof. Another, insulated roof structure is disclosed in U.S. Pat. No. 4,047,346, also to Robert J. Alderman, which includes a reel of wire mesh and a cooperating reel of sheet material carried by a supporting framework to faciliate progressively unrolling the layers of wire mesh and sheet material for application to the spaces between the roof and purlins. Insulation is then placed in the wire and sheet material trough, in order to insulate the roof.

It is an object of this invention to provide in one embodiment, new and improved insulation configurations for insulating the attics, walls and floors of homes, offices, and other structures, which insulation configurations are each characterized by one or more moisture-permeable film or membrane layers covering and/or placed between layers of insulation resting on the ceiling in the attics, between studs or other wall supports and between floor joists, which film or films isolate the insulation into layers or cells and serve to minimize air infiltration and circulation through the insulation, to increase the insulating efficiency.

Another object of this invention is to provide an improvement to existing insulation in an insulated attic having a layer of sheetrock attached to the bottom of supporting attic ceiling joists and a mass of insulation located between the ceiling joists and supported by the sheetrock, which improvement includes placing a moisture vapor-permeable film or membrane of selected thickness over the insulation and adding additional layer of insulation, with another film extending over the second layer of insulation, in order to minimize the infiltration of air through the insulation layers and thereby improve the efficiency of the insulation.

A still further object of the invention is to provide improved insulation configurations for attics, floors having floor joists and walls, which configurations include at least one water vapor-permeable plastic membrane or film of selected thickness covering and/or installed in a quantity of insulation located on sheetrock between the ceiling joists of the attic, between floor joists, or between studs in a wall, which membrane or membranes serve to isolate discrete layers of insulation and substantially prevent air from circulating through the isolated layers and increases the efficiency of the insulation, while allowing moisture to migrate through the isolated insulation layers without collecting therein and damaging the insualtion, the underlying sheetrock or any structural members.

Still another object of this invention is to provide a method for increasing the efficiency of insulation in the attics, floors and walls of structures, which method includes the expedient of placing one or more layers of water vapor-permeable membrane or film in and over the insulation, in order to create boundary surfaces and isolate discrete layers of insulation to prevent extensive infiltration and circulation of air through the isolated layers or cells of insulation.

A still further object of the invention is to provide a method for minimizing the circulation of air and heat through insulation installed in the attics, walls and floors of strucures, which method includes installing at least on moisture-permeable, plastic membrane or film over and/or in the insulation, in order to substantially isolate multiple layers or cells of insulation and increase the efficiency of the insulation.

SUMMARY OF THE INVENTION

These and other objects of the invention are provided in insulation configurations for enhancing the insulating capability of insulation provided in the attics, walls, and floors of structures which configurations include at least one, and preferably several, moisture vapor-permeable membranes of selected thickness positioned in and around the insulation, in order to isolate discrete layers or cells of insulation. A method for reducing air flow through insulation located in the attic, floor and walls of structures and thereby increasing the efficiency of the insulation, which method includes placing at least one, and preferably several water vapor-permeable membranes or films of selected thickness in spaced relationship around and in the insulation, to substantially isolate discrete layers of the insulation.

BRIEF DESCRIPTION OF THE DRAWING

The invention will be better understood by referenced to the accompanying drawing, wherein.

DESCRIPTION OF THE PREFERRED EMBODIMENTS

Figure 1:
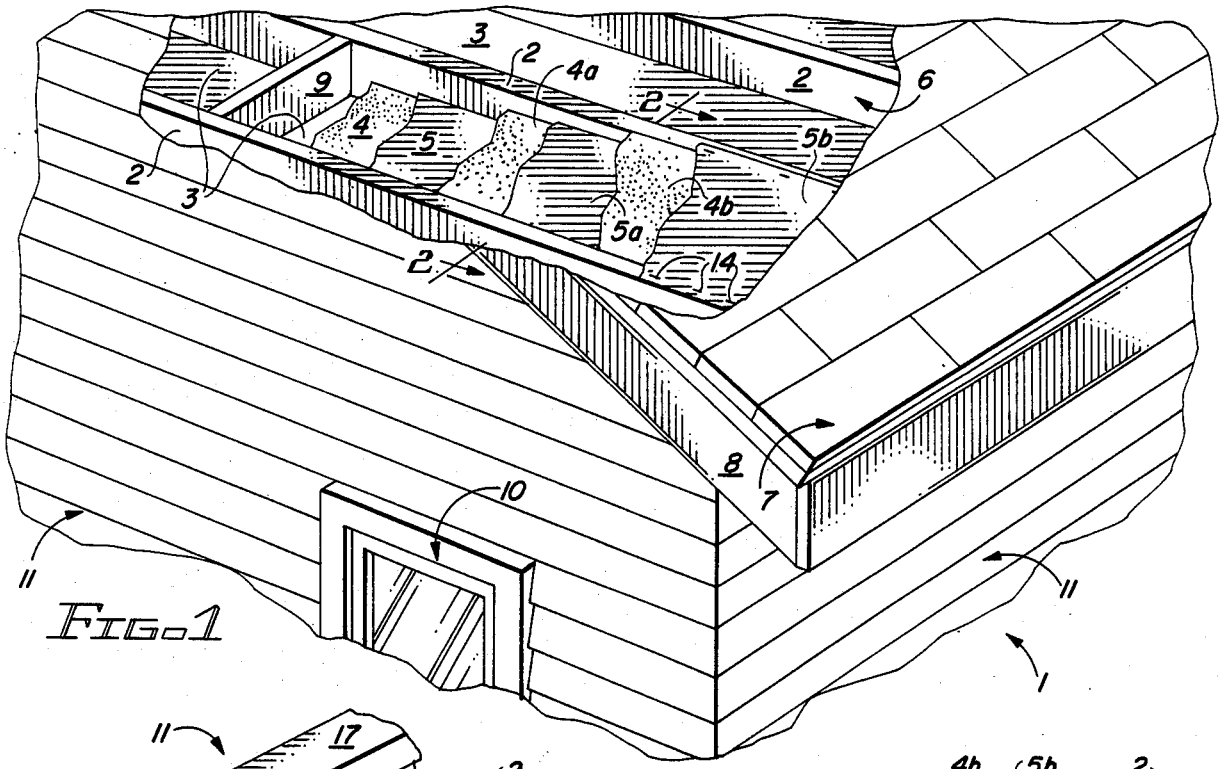
FIG. 1 is a perspective view, partially in section, of a structure with the attic area open to inspection and illustrating a preferred insulation configuration and method of this invention.
Figure 2:
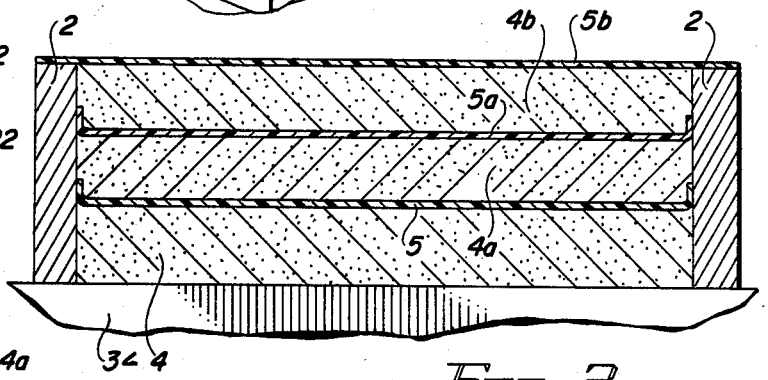
FIG. 2 is a sectional view taken along line 2—2 in FIG. 1, of a segment of the insulation configuration illustrated in FIG. 1.

Referring initially to FIG. 1 of the drawings a structure 1 is illustrated, with walls 11, a window 10 and an attic 6, having a roof 7, carrying roof trusses 8. As illustrated in FIGS. 1 and 2, a preferred insulation configuration for the attic 6 is generally illustrated, with a first layer of blown, particulate insulation 4, located between the ceiling joists 2 and resting on the ceiling material 3 attached to the bottom thereof. A first sheet of film 5 is positioned over the first layer of insulation 4 and is stapled to the ceiling joists 2 by means of staples 14, and a second layer of insulation **4*a* is located on the first sheet of film 5. A second sheet of film 5*a* is stapled to the ceiling joists 2 over the second layer of insulation 4*a* and a third layer of insulation 4*b* is positioned on the second sheet of film 5*a*. A third layer of film 5*b* is then stapled over the third layer of insulation 4*b*, to complete the insulation configuration. The insulation 4 can be applied to the ceiling material 3 and located between the ceiling joists 2 by means of a blowing apparatus, in the case of particulate, loose-fill insulation such as fiberglass and the like, or by laying shaped batts or rolled sheets of non-solid, fibrous insulation between the ceiling joists 2 and the spacer 9, or by other techniques which are known to those skilled in the art. As illustrated in FIG. 1, the ceiling material 3, which is typically "sheetrock" or "gypsum board" material, serves to prevent air encroachment or infiltration into the insulation from the bottom. The insulation mass is thus isolated by boundaries into three discrete layers; a first layer 4, a second layer 4*a* and a third layer 4*b***, to limit air infiltration and circulation and reduce heat transfer.

Figure 3:
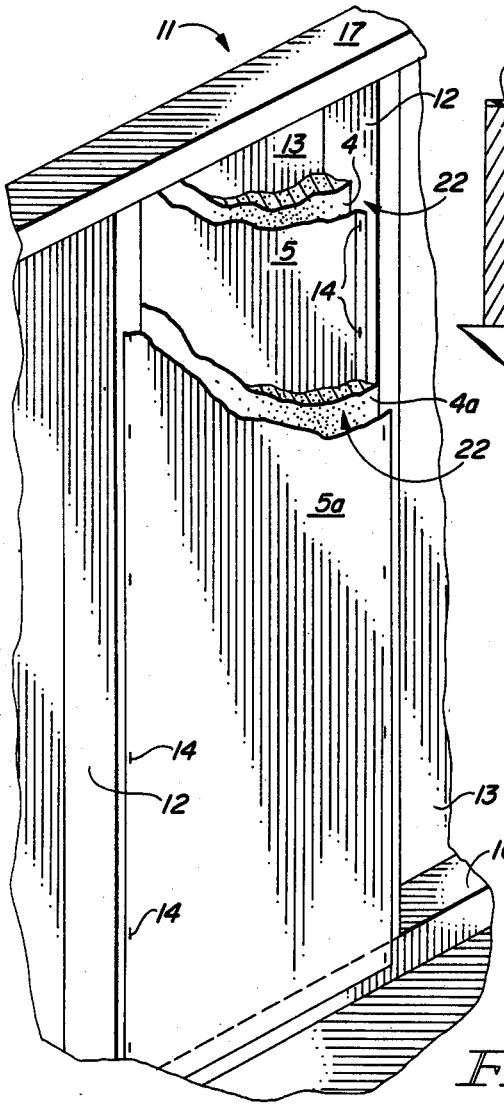
FIG. 3 is a perspective view, partially in section, of a wall segment illustrating a second insulation configuration.

Referring now to FIG. 3 of the drawing, a second insulation configuration is illustrated in the walls 11 between the studs 12, which are constructed in an upright configuration between the top plate 17 and the toe plate 16. A conventional wall decking 13 of a design which is well known to those skilled in the art, is initially applied to the outside of the studs 12, to form a base for the insulation batts 22, which are applied adjacent the wall decking 13 and form a first layer of insulation 4. After the first insulation batt 22 is placed in position between the studs 12 as illustrated, a first sheet of film 5 is stapled to the inside of the studs 12 against the first layer of insulation 4 and a second insulation batt 22 is applied adjacent the first sheet of film 5, to define a second layer of insulation **4*a*. A second sheet of film 5*a* is then applied over the second sheet of insulation 4*a* and is secured to the inside of the studs 12 by means of additional staples 14. Accordingly, it will be appreciated from a consideration of FIG. 3 of the drawing that the multiple layers of insulation batts 22 and the first sheet of film 5 and second sheet of film 5*a* form separate moisture vapor-permeable, insulating barriers or segments which are not affected by air which may incidentally leak into the walls 11 and circulate therein. Any such leaking air cannot readily circulate through the insulation batts 22 because of the presence of the first sheet of insulation film 5 and second sheet of insulation film 5*a*. Accordingly, the efficiency of the insulation located between the studs 12 is much higher than it would be under circumstances where a single thickness of insulation batts 22** is used.

Figure 4:
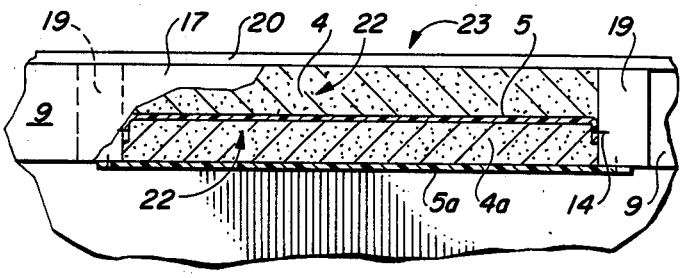
FIG. 4 is a sectional view of a floor segment illustrating a third insulation configuration.

Referring now to FIG. 4 of the drawings in a third insulation configuration, a floor decking 20 is mounted to one edge of the parallel floor joists 19 and insulation batts 22 can be positioned adjacent the floor decking 20 and between the floor joists 19 and the spacers 9. The insulation batts 22 can be stapled or otherwise secured in this position by methods known to those skilled in the art, to define a first layer of insulation 4. A first sheet of film 5 is then secured to the floor joists 19 by means of staples 14 and a second layer of insulation **4*a* is applied as insulation batts 22, against the first sheet of film 5 and is stapled or otherwise secured to the floor joists 19. A second sheet of film 5*a* is then stapled to the ends of the floor joists 19 against the second layer of insulation batts 22, to form a sandwich construction of alternating layers of insulation and film in order to minimize the infiltration and circulation of air beneath the floor 23 through the isolated layers of insulation batts 22**.

Figure 5A:
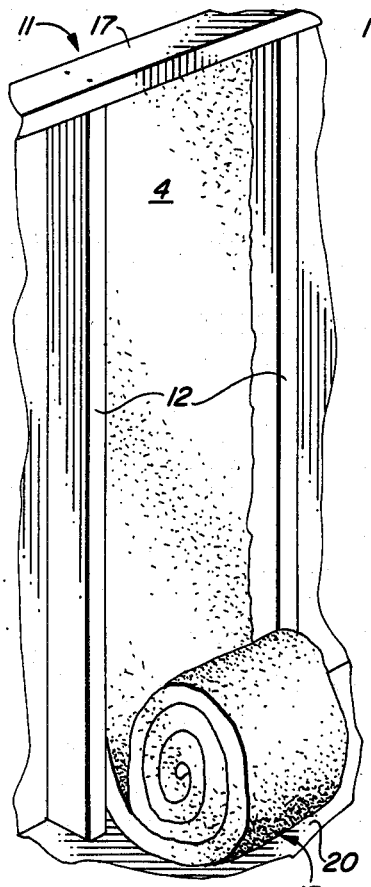
FIGS. 5A–5C represent successive stages in the installation of insulation and film in a wall according to one embodiment of the invention.
Figure 5B:
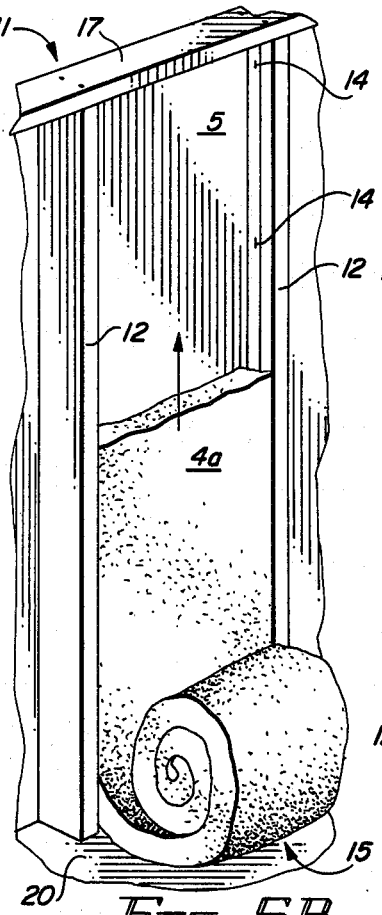
Figure 5C:
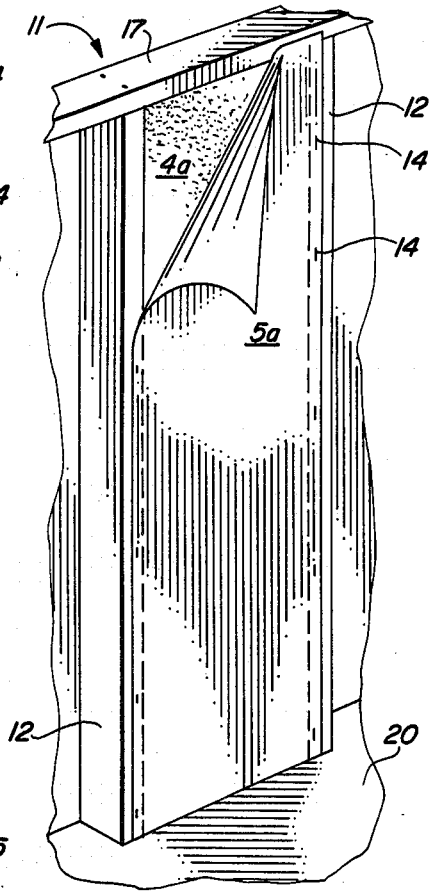
Figure 6:
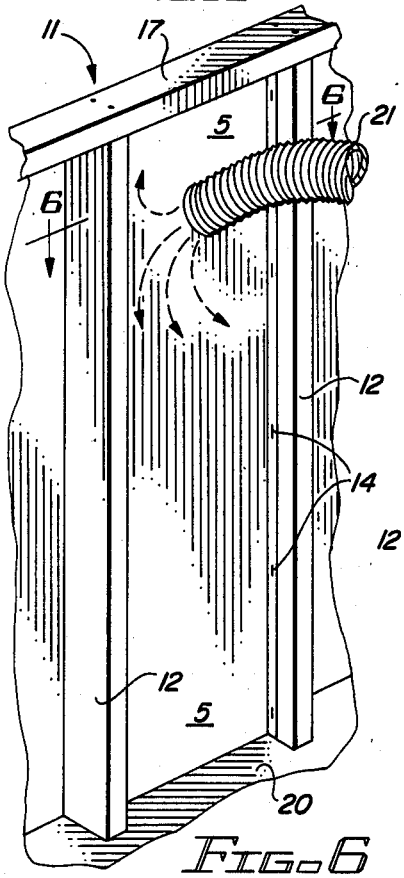
FIG. 6 is a perspective view, partially in section, of a wall segment illustrating a preliminary step in applying particulate insulation.

Referring now to FIGS. 5A–5C of the drawings in another preferred aspect of the FIG. 3 embodiment of the invention, the walls 11 are provided with a first layer of insulation 4 and a second layer of insulation **4*a*, spaced by a first sheet of film 5 and with a second sheet of film 5***a*, as in the case of the walls 11 illustrated in FIG. 3. However, in FIGS. 5A–5C the first layer of insulation 4 and second layer of insulation 4*a* are cut from an insulation roll 15, according to the knowledge of those skilled in the art. It will be appreciated from a consideration of FIGS. 5*a*–5*c* that the insulation roll 15 is of sufficient width to tightly fit between the studs 12 and is of selected thickness. Furthermore, the second sheet of film 5*a* is, in a preferred embodiment, stapled to the outside edge of the studs 12 by means of additional staples 14, in order to better secure the first layer of insulation 4 between the studs 12 when the drywall or other wall surface (not illustrated) is applied.

Figure 7:
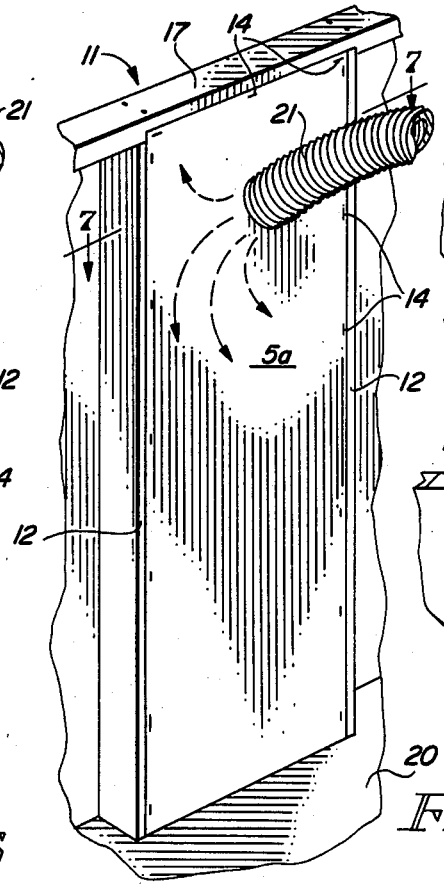
FIG. 7 is a perspective view, partially in section, of the wall segment illustrated in FIG. 6, illustrating a final stop in applying the particulate insulation.
Figure 8:
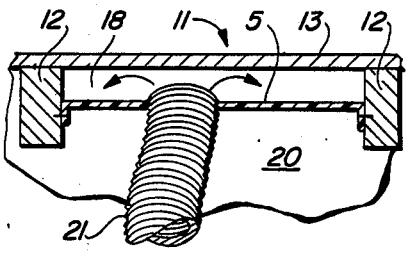
FIG. 8 is a sectional view, taken along line 8—8 in FIG. 6, of the wall segment illustrated in FIG. 6.
Figure 9:
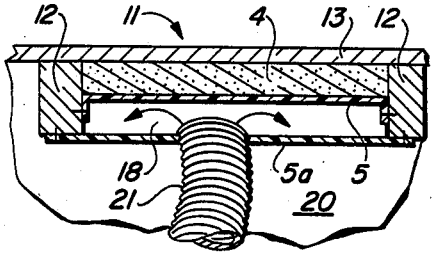
FIG. 9 is a sectional view, taken along line 9—9 in FIG. 7, of the wall segment illustrated in FIG. 7.

In yet another preferred aspect of that embodiment of the invention illustrated in FIGS. 3 and 5*a*–5*c*, and referring also to FIGS. 6–9, a first sheet of film 5 can be stapled to the studs 12 in spaced relationship from the wall decking 13 and a hose 21 used to apply particulate insulation in the insulation space 18 defined by the wall decking 13, the first sheet of film 5 and the studs 12, as illustrated in FIGS. 8 and 9. After the initial layer of insulation is applied to the first insulation space 18, a second sheet of film 5*a* can be stapled into position using staples 14, as illustrated in FIG. 7 and the hose 21 used to apply a second layer of insulation in the second insulation space 18.

It will be appreciated by those skilled in the art that the insulation configurations of this invention are designed primarily to minimize the penetration of air into, and the circulation of air through the insulation, in order to reduce the convective transfer of heat carried by the air from one surface to another. Although it will be recognized by those skilled in the art that it is impossible to absolutely prevent air from infiltrating any insulation which is provided with one or more moisture vapor-permeable films or membranes, the isolation of discrete layers or cells of insulation by means of such boundary films operates to substantially confine air circulation to each respective cell or layer, instead of facilitating air circulation throughout the entire mass of insulation. This expedient minimizes convective heat transfer through the insulation mass and heat conduction through the film layers. The most dramatic effect of the insulation configuration of this invention is in the attic installation, since air circulation is greater in the attic than in any other area, except perhaps floor structures, where the structures are elevated from the ground. This is particularly true since hot air rises and has the tendency to transfer through the ceiling area of a structure, resulting in heat transfer through the ceiling and into the attic and a great loss of heat to the atmosphere through the roof.

The practice and advantages of this invention will become further apparent from a consideration of the following examples. It will be appreciated, however, that these examples are presented for purposes of illustration and are not intended to unduly limit the scope of the invention.

EXAMPLE 1

The test in this example was set up to illustrate the reduced efficiency of insulation as a result of air circulation through the insulation. Two boxes, measuring one foot on each side, were built using wood frames. One inch of polyurethene insulation was installed on one of the boxes on all six sides, and three inches of fiberglass batt insulation was installed on each of the six sides of the other box. 25 ice cubes were placed in each box and the boxes were placed next to the air outlet of an electric clothes dryer located in a garage. Temperature measurements were noted in each box and in the garage in which the dryer outlet and the boxes were located. The temperature in the box with the polyurethene insulation ranged from 52° to 58° F., while the temperature in the box with the fiberglass batt ranged from 81° to 88° F. The test illustrates the reduced insulating efficiency of the fiberglass insulation as a result of air circulation through the insulation.

EXAMPLE 2

The test in this example was designed to determine whether insulation can be improved by placing horizontal membranes in the insulation in order to form closed cells to reduce air circulation and flow through the insulation. A box measuring 36 inches by 44 inches and 48 inches high was constructed of ¾ inch plywood in order to simulate a room. Four cells of equal size (15 inches by 19 inches) were built on top of a sheetrock partition mounted in the box. Insulation was placed in each cell. One cell had no membrane placed over the insulation, while a second cell was fitted with a polyethelene membrane having a thickness of 2 mils placed over the insulation. A third cell was provided with a like membrane placed over the insulation and a second membrane midway through the thickness of the insulation, while the fourth cell was provided with a membrane over the insulation and two membranes located equidistantly apart in the insulation itself. The box was then placed in a cooler and a 200 watt light bulb was placed inside the box for heating purposes. Data was collected several times each day for several days and temperatures were measured under the insulation next to the sheetrock partition. There was a significant improvement in the insulating characteristics of the insulation provided with membranes. Using comparisons and ratios, "R" values and "K" values were calculated for the various insulation configurations. The following table summerizes the results of Example 2:

| | No Insul(°F.) | No Membrane (°F.) | 1 Membrane (°F.) | 2 Membrane (°F.) | 3 Membrane (°F.) | Temp In Box (87° F.) |
|---|---|---|---|---|---|---|
| | | | Cooler Temp. (37° F.) | | | |
| Temperature Under Insulation | 42 | 48 | 63 | 70 | 75 | |
| Temp. diff. Between box & Top of Sheetrock | 47 | 39 | 24 | 17 | 12 | |
| "R" Value | | 1 | 10 | 16.2 | 20 | |
| "K" Value | | 10 | 1 | .62 | .5 | |
| | | | Cooler Temp. (53° F.) | | | |
| Temperature | 57 | 63 | 73 | 80 | 83 | |

-continued

| | No Insul(°F.) | No Membrane (°F.) | 1 Membrane (°F.) | 2 Membrane (°F.) | 3 Membrane (°F.) | Temp In Box (87° F.) |
|---|---|---|---|---|---|---|
| Under Insulation Temp. diff. Between Box & Top of Sheetrock | 30 | 24 | 14 | 7 | 4 | |
| "R" Value | | 1 | 10 | 20 | 30.5 | |
| "K" Value | | 10 | 1 | .5 | .33 | |

EXAMPLE 3

This experiment was conducted using the attic of a home located in Shreveport, La., under various weather conditions. Upon inspection, the attic of the home was provided with nine inches of insulation located between the ceiling joists and resting on a sheetrock ceiling material secured to the bottom of the ceiling joists. The house was certified by Southwestern Electric Power Company for maximum energy efficiency. Temperature measurements in the attic when the attic air space temperature was 125° F., indicated that the temperature beneath the insulation and next to the sheetrock layer was 114° F., for an 11 degree temperature drop through the nine inch insulation layer. The temperature next to the sheetrock inside the house was 82° F., for a 32 degree temperature drop through the sheetrock, indicating that the insulation was providing very little insulating benefit.

A 2 mil film of polyethylene was installed between two of the ceiling joists and over the insulation between these ceiling joists in the attic of the house and the temperature was recorded at various points with a Doric Digital Trendicator furnished by the Department of Energy. At a point between the ceiling joists containing the film and beneath the insulation at the sheetrock layer, the temperature was checked and was found to be 92° F., for a 33 degree drop through the insulation and a 10° drop through the sheetrock, indicating a marked increase (threefold) in the efficiency of the insulation when the film was installed. The following table summarizes the results of EXAMPLE 3:

| CHARACTER OF INSULATION | ΔT ACROSS INSULATION(°F.) | ATTIC AIR TEMP(°F.) | TEMP@BOTTOM OF INSULATION ADJACENT CEILING (°F.) | ROOM TEMP STRUCTURE ADJACENT CEILING |
|---|---|---|---|---|
| NO FILM | 15 | 40 | 55 | 70 |
| WITH FILM | 22 | 40 | 62 | 70 |
| NO FILM | 12 | 50 | 62 | 70 |
| WITH FILM | 18 | 50 | 68 | 70 |
| NO FILM | 11 | 125 | 114 | 82 |
| WITH FILM | 33 | 125 | 92 | 82 |

EXAMPLE 4

Another home in Shreveport, La. was provided with a 2 mil sheet of polyethylene over the entire ceiling joist area which contained insulation located between the ceiling joists and resting on the sheetrock ceiling divider. This data was correlated, computed and indicated a 59% reduction in heating and cooling costs and a 35% reduction in total utility costs for the winter of 1981 and 1982. Additional study of data collected in this house in the summer of 1982 and winter of 1982–1983, indicated that the heating and cooling energy usage was reduced by 50% to 75% due to the installation of the film.

EXAMPLE 5

One of the questions raised during the experiments conducted with polyethylene or other film is that of water collection in the insulation as a result of the presence of the film. In order to determine the nature and extent of any such water collection, a styrofoam ice chest was fitted with a hole in the top and a jar was placed snugly in the hole. The jar was covered with a sheet of two mil polyethylene anchored snugly by several heavy rubber bands. The box was then filled with ice and the jar was immersed in the ice. The entire box was then placed in a bathroom with the heater turned on. After 48 hours, approximately ⅛ of an inch of water was observed to have collected in the bottom of the jar and there was condensation on the inside of the jar, which indicated that heat flow through the membrane and accompanying differential vapor pressure caused water vapor flow through the membrane. The heat could freely pass through the glass into the ice and the moisture collected inside the glass, since the glass was an effective vapor barrier.

EXAMPLE 6

In order to further investigate the question of water vapor collection in insulation, a box four feet square on each side was constructed and the top of the box was fabricated similar to that of a home of commercial structure, with one-half inch sheetrock used as a ceiling material and fiberglass batts having a thickness of 8 inches installed over the sheetrock to simulate the attic area. A two mil sheeting of polyethylene was installed over one of the batts and a rack supporting two pans of water and an electric light bulb was placed inside the box. The box was then placed inside a cooler, where the temperature was maintained at a temperature of 40° F. and numerous temperature measurements were made and recorded. The points of measurements were located inside the box and at points where insulation rested on the sheetrock ceiling material. Initially, tests were conducted using a 300 watt heat lamp directed at the sheetrock inside the box. The temperature beneath the insulation and adjacent the sheetrock was found to be over 100° F. and moisture condensation was noted in both the insulation which was covered by the film and in the insulation which was not so covered. The heat lamp was replaced by a 100 watt light bulb and the temperature inside the box was noted to be 60° F. A relative humidity reading of 70% was also noted. After approximately 48 hours, the moisture was observed to have evaporated and there was no evidence of condensation in either the insulation covered by the polyethylene film or the bare insulation. The 100 watt light bulb was then replaced by a 200 watt light bulb, which raised the temperature inside the box to 74° F. and a relative humidity of 80% was noted. After 72 hours, moisture condensation was observed in both the insulation with and without the film covering. This experiment was run several times and it was always observed that the condensation disappeared when the 100 watt light bulb was installed and after a forced due point condition had been observed. In both cases, lab tests indicated that the moisture content was higher in the insulation which was not covered by film than in the insulation covered by the film. It is believed that the air circulation in the insulation from the refrigeration unit in the cooler carried air into the insulation which was not covered by the film, thus creating a higher dew point condition.

It will be appreciated by those skilled in the art that a primary objective of this invention is to reduce convective heat losses in all types of non-solid, as contrasted with solid (eg, polyurethane, polystyrene and like material) insulation, by using water vapor-permeable film. Accordingly, while the required discrete layers or cells of insulation can be created in situ, as described above with respect to the drawings, it will be recognized that the insulation itself can be provided with film coverings, either on one side, both sides, in a sheath, or with all of these combinations, and also using intermediate layers of film to isolate thinner layers of insulation. Thus, batts and rolled, non-solid insulation of any description can be provided with film coverings and/or layers, accordingly to the teachings of this invention. For example, referring again to FIG. 2 of the drawings, the third layer of insulation 4*b* can be provided with a second sheet of film 5*a*, which is laminated or attached to one side of the third layer of insulation 4*b* at the factory, instead of being attached to the ceiling joists 2. Alternatively, the second sheet of film 5*a* and a third sheet of film 5*b* can be attached to opposite sides of the third layer of insulation 4*b*. The insulation batt 22 which corresponds to the third layer of insulation 4*b* can thus be positioned between the ceiling joists 2, or between floor joists 19 or studs 12, as illustrated in FIGS. 3 and 4, with no pre-installation of the film. Successive layers of insulation batts 22 which are so characterized can also be used in stacked relationship, in order to provide multiple, discrete layers or cells of insulating material according to specific insulation needs. Such insulation batts 22 can be installed in new structures or in old structures already provided with insulation, in order to greatly increase the efficiency of the existing insulation, as desired.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. An insulation configuration for attic floors comprising a layer of non-solid insulation material adjacent said attic floor and at least one moisture vapor-permeable film means positioned horizontally over said insulation material and exposed to the air, whereby air circulation into said insulation material from the attic is reduced.

2. The insulation configuration of claim 1 wherein said insulation material is particulate insulation.

3. The insulation configuration of claim 1 wherein said film means is a plastic film.

4. The insulation configuration of claim 1 wherein said film means is an outer film defining a first boundary of said insulation material and further comprising an inner film horizontally spaced from said outer film, said inner film defining a second boundary of said insulation material, with said insulating material located between said outer film and said inner film, said outer film and said inner film reducing air circulation within said insulating material.

5. The insulation configuration of claim 4 further comprising at least one intermediate film horizontally disposed in said insulating material between said outer film and said inner film, said intermediate film spaced from said outer film and said inner film, with a first quantity of said insulating material located between said outer film and said intermediate film and a second quantity of said insulating material located between said intermediate film and said inner film.

6. The insulation configuration of claim 1 wherein:

(a) said insulation material further comprises particulate insulation; and (b) said film means is an outer film defining a first boundary of said particulate insulation and further comprising an inner film horizontally spaced from said outer film, said inner film defining a second boundary of said particulate insulation, with said particulate insulation located between said outer film and said inner film, said outer film and said inner film reducing air circulation within said particulate insulation.

7. The insulation configuration of claim 1 wherein said insulation material is fibrous insulation.

8. The insulation configuration of claim 7 wherein said film means is an outer film defining a first boundary of said fibrous insulation and further comprising an inner film horizontally spaced from said outer film, said inner film defining a second boundary of said fibrous insulation, with said fibrous insulation located between said outer film and said inner film, said outer film and said inner film reducing air circulation within said fibrous insulation.

9. The insulation configuration of claim 8 further comprising at least one intermediate film horizontally disposed in said fibrous insulation between said outer film and said inner film in spaced relationship, with a first quantity of said fibrous insulation located between said outer film and said intermediate film and a second quantity of said fibrous insulation located between said intermediate film and said inner film.

10. An insulation configuration for floors in structures comprising a layer of insulating material located adjacent the underside of the floor and at least one moisture vapor-permeable film means positioned horizontally under said insulating material and exposed to the air, whereby circulation of air into said insulating material from the airspace beneath the floor is reduced.

11. The insulation configuration of claim 10 wherein said at least one film means is an outer film defining a first boundary of said insulation material and further comprising an inner film horizontally spaced from said outer film, said inner film defining a second boundary of said insulation material, with a layer of insulating material located between said outer film and said inner film, said outer film and said inner film reducing air circulation within said insulating material.

12. The insulating configuration of claim 11 further comprising at least one intermediate film horizontally disposed in said insulating material between said outer film and said inner film in spaced relationship, with a first quantity of said insulating material located between said outer film and said intermediate film and a second quantity of said insulating material located between said intermediate film and said inner film.

13. The insulating configuration of claim 10 wherein said insulating material is fibrous insulation.

14. A method for increasing the efficiency of a non-solid insulation layer adjacent the floor of an attic comprising installing at least one sheet of moisture-vapor permeable film horizontally over said insulation layer and exposed to the air in the attic, to reduce air circulation into said insulation.

15. A method for increasing the efficiency of non-solid insulation layer adjacent the underside of the floor of a structure comprising installing at least one sheet of moisture-vapor permeable film horizontally under said insulation layer and exposed to the air beneath the floor, to reduce air circulation into said insulation from the airspace beneath the floor.

* * * * *